United States Patent [19]

Shida et al.

[11] 4,141,727

[45] Feb. 27, 1979

[54] ELECTRICAL CONTACT MATERIAL AND METHOD OF MAKING THE SAME

[75] Inventors: Sankichi Shida, Nara; Shinji Okuma, Moriguchi; Mashiro Oita, Kashiwara; Hyogo Hirohata, Neyagawa, all of Japan

[73] Assignee: Matsushita Electric Industrial Co., Ltd., Japan

[21] Appl. No.: 855,904

[22] Filed: Nov. 29, 1977

[30] Foreign Application Priority Data

Dec. 3, 1976 [JP] Japan ..... 51-145789
Dec. 29, 1976 [JP] Japan ..... 51-159613

[51] Int. Cl.[2] ..... B22F 3/00; H01H 1/02

[52] U.S. Cl. ..... 75/232; 75/200; 75/211; 75/224; 75/234; 148/126; 252/514; 428/929; 200/265; 200/266; 200/270

[58] Field of Search ..... 200/265, 266, 270; 75/232, 234, 200, 211, 224; 428/929; 148/126; 252/514

[56] References Cited

U.S. PATENT DOCUMENTS

| | | | |
|---|---|---|---|
| 2,486,341 | 10/1949 | Stumbock | 200/265 |
| 2,890,315 | 6/1959 | Graves, Jr. | 75/232 |
| 3,205,565 | 9/1965 | MacDonald | 75/232 |
| 3,489,531 | 1/1970 | Schreiner et al. | 75/241 |

FOREIGN PATENT DOCUMENTS

| | | | |
|---|---|---|---|
| 564548 | 10/1958 | Canada | 200/266 |
| 2102996 | 8/1972 | Fed. Rep. of Germany | 75/232 |

*Primary Examiner*—Brooks H. Hunt
*Attorney, Agent, or Firm*—Wenderoth, Lind & Ponack

[57] ABSTRACT

An electrical contact material comprising silver, bismuth oxide and tin oxide with or without tin metal, wherein the amounts of the bismuth and the tin on the basis of the sum weight of the metals in both the metal component and in the metal oxide component are 1.5 to 6 weight percent and 0.1 to 6 weight percent, respectively. Tnis electrical contact material has high resistance to both welding and arc erosion. An advantageous method of making the electrical contact material comprises preparing a metal alloy composed of all the above metals in the above weight ratio and internally oxidizing the bismuth completely in the alloy after shaping the alloy to a desired electrical contact material shape or after crushing the alloy to scaly flakes.

19 Claims, No Drawings

ELECTRICAL CONTACT MATERIAL AND METHOD OF MAKING THE SAME

This invention relates to an electrical circuits material suitable for use in making and breaking electric currents, and also relates to a method of making the electrical contact material.

Electrical contacts of silver have found the widest general use, as silver has an excellent electric current carrying capacity and is relatively cheap. However, silver contacts suffer from disadvantages of welding and arc erosion as well as metal transfer from one contact to the other. Such disadvantages are magnified when heavy electric currents are applied thereto. Attempts had, therefore, been made to improve silver and the like contacts, primarily by alloying with other metals, for obtaining better properties of such contacts.

As one of such improved silver alloy contacts, silver-cadmium oxide is known and has found wide application for high currents switches such as those used in industrial electric apparatus. In general, contacts of this type, such as silver-base metal oxide contacts, are formed by powder-metallurgical procedures from silver and base metal oxide powders or preferably by internally oxidizing silver base metal alloys. While silver cadmium oxide contacts have many excellent qualities, as a result of which they have met wide public acceptance, they have a disadvantage as to welding and arc erosion in those applications where contact closing and opening speed is relatively slow and where the contact opening force is low.

In this connection, Japanese non-examined laid-open patent publication (Kokai) No. 50-110098/1975 discloses an electrical contact material made by internally oxidizing an alloy composed of silver as a major ingredient and, as additives, at least 5 weight percent of tin (or at least 3 weight percent of tin when zinc is used in conjunction with tin) and not more than 1 weight percent of bismuth. However, such known electrical contact material has poor properties as to the welding and arc erosion (i.e. loss of the material by arc), and particularly suffers from very low resistance to welding, i.e. welding very often occurs.

It is an object of this invention to provide an electrical contact material which has desirable high resistance to both welding and arc erosion.

It is another object of this invention to provide a method of making an electrical contact material on a practical and industrial scale at a low cost.

These and other objects and features of this invention will become apparent from the following description.

It is the discovery on which this invention is based that an electrical contact material can have unexpectedly high resistances to both welding and arc erosion when the electrical contact material comprises a metal component as a major ingredient and the remainder of a metal oxide component as a minor ingredient, wherein the metal component consists essentially of silver with or without tin, and the metal oxide component consists essentially of bismuth oxide and tin oxide, wherein the amount of the bismuth of the bismuth oxide is 1.5 to 6 weight percent, and the total amount of the tin of the metal oxide component and the tin of the metal component (if present) is 0.1 to 6 weight percent, respectively, both on the basis of the sum weight of the metal component and all the metals of the metal oxide component.

An important point is that the bismuth of the bismuth oxide should be at least 1.5 weight percent on the basis of the total metals as above defined. If the amount of the bismuth oxide is too small, the resultant electrical contact material has unacceptably poor resistance to welding. However, if the amount of the bismuth oxide is unacceptably large relative to the amount of the tin in the metal component and the metal oxide component, the resultant material has unacceptably poor resistance to arc erosion. If the amount of the total tin in the metal component (if present) and the metal oxide component is unnacceptably small, the resultant electrical contact material has too poor resistance to arc erosion. However, if the amount of the tin is too large relative to the bismuth, the resultant material has too poor resistance to welding.

The electrical contact material of this invention can be made by first preparing a metal alloy composed of all the above recited metals in the above recited weight ratio and internally oxidizing the bismuth completely in the alloy, or by first preparing a metal oxide powder mixture in the above recited weight ratio and heating the oxide powder mixture. Depending on various conditions of the method of preparation, bismuth oxide and tin oxide may be present in the resultant material in the form of bismuth oxide particles ($Bi_2O_3$) and tin oxide particles ($SnO_2$) and/or may be present in the form of bismuth-tin oxide particles ($Bi_2Sn_2O_7$). However, irrespectively of the forms in which the bismuth oxide and tin oxide are present in the resultant material, the resultant material is operable.

However, if many bismuth-tin oxide particles ($Bi_2Sn_2O_7$) are present in the resultant material, it becomes very hard and becomes somewhat difficultly machinable or shapable to form an electrical contact. This disadvantage can be eliminated by incorporating copper oxide or zinc oxide, as an additive oxide, in the resultant material in such amount that the metal, i.e. copper or zinc, of the additive oxide is 0.016 to 1.2 weight percent on the basis of the sum of the metal oxide component and all the metals of the metal oxide component in the resultant contact material. If the amount of this additive component is too small, the effect of this additive addition does not occur, while if the amount thereof is too large, the resultant material has unacceptably poor resistance to arc erosion.

Thus, within the compositional range of the material according to this invention, it has been confirmed that there are the following four types of compositions. (Since the material of this invention is embodied in one of the four types depending on the weight ratio of respective used elements and the method of production, the type to which the resultant material belongs, and the amounts of the respective resultant oxides such as $Bi_2Sn_2O_7$ are not very important as long as the material can be defined by the weights in terms of the metals, as defined above.):

First type: A material having a constitution consisting essentially of silver, bismuth-tin oxide ($Bi_2Sn_2O_7$) having pyrochlore structure and bismuth oxide ($Bi_2O_3$), wherein the bismuth-tin oxide and the bismuth oxide are dispersed throughout the silver matrix in the form of finely divided particles;

Second type: A material having a constitution consisting essentially of silver, bismuth-tin oxide and tin oxide ($SnO_2$), wherein the bismuth-tin oxide and the tin oxide are dispersed throughout the silver matrix in the form of finely divided particles;

(In a special case of both the first and the second types, the material has a constitution consisting essentially of silver and bismuth-tin oxide ($Bi_2Sn_2O_7$), wherein the bismuth-tin oxide are dispersed throughout the silver matrix in the form of finely divided particles.)

Third type: A material having a constitution consisting essentially of silver, tin, bismuth oxide ($Bi_2O_3$) and tin oxide ($SnO_2$), wherein the bismuth oxide and tin oxide are dispersed throughout the silver-tin matrix in the form of finely divided particles; and Fourth type: A material having a constitution consisting essentially of silver, bismuth-tin oxide ($Bi_2Sn_2O_7$), one of oxides selected from the group consisting of bismuth oxide ($Bi_2O_3$) and tin oxide ($SnO_2$), and one of the oxides selected from the group consisting of copper oxide (CuO) and zinc oxide (ZnO), wherein the bismuth-tin oxide and the other oxides are dispersed throughout the silver matrix in the form of finely divided particles. In the case of the composition of the fourth type, a part of bismuth oxide and copper oxide or zinc oxide may be converted into their compound oxides by heating for making contact materials at a suitable temperature. Each compound oxide has a formula of $CuBi_xO_y$ and $ZnBi_xO_y$, where [x, y] combination is one of [2, 4], [4, 7] and [48, 73]. Typical formulas are spinel $CuBi_2O_4$, $ZnBi_4O_7$ and monoclinic $ZnBi_{48}O_{73}$. Such compound oxides have a melting temperature lower than that of bismuth oxide. However, when the compound oxides are melted at a temperature higher than 870° C. and the melt is quenched, the resultant compound oxides will be converted to the sublimate oxides having a sublimation temperature higher than the melting temperature of silver. Such conversion occurs to some extent with bismuth oxide, too. By this treatment, the monoclinic oxide $Bi_2O_3$ having a melting temperature of 825° C. is converted into the cubic oxide $Bi_2O_3$ having a sublimation temperature of about 1000° C.

Contact materials of the four types are formed by internally oxidizing an alloy consisting of silver, bismuth and tin with or without other additive ingredients. The internal oxidization of the alloy is accomplished by heating in an oxidizing atmosphere such as oxygen or air at a temperature higher than 500° C., but lower than the melting temperature of the alloy for a suitable period. In general, the heating of the alloy in air at a temperature higher than 600° C., but lower than the melting temperature of bismuth oxide for 20 to 200 hours provides satisfactory results. It appears that, during this treatment, oxygen is absorbed into the alloy and will be combined with the bismuth and the tin to form bismuth oxide and tin oxide, respectively, but will not be combined with the silver.

On the one hand, the bismuth oxide will be combined with the tin oxide by heating, at a temperature between 750° and 850° C., and in consequence of such treatment, bismuth-tin oxide ($Bi_2Sn_2O_7$) having a melting temperature higher than 1100° C. is formed. In the combination of bismuth oxide and tin oxide, a molecular weight ratio of the bismuth oxide to the tin oxide is 1:2:

$$Bi_2O_3 + 2SnO_2 \rightarrow Bi_2Sn_2O_7$$

Thus, the resulting product will comprise a silver matrix with the bismuth-tin oxide ($Bi_2Sn_2O_7$) and the remainder oxide of the combination of the bismuth oxide and the tin oxide, which are uniformly dispersed throughout the silver matrix in the form of finely divided particles, and will coincide with the material of the above mentioned first type or the second type.

On the other hand, the contact material of the third type will be formed by the interruption of the internal oxidizing treatment when bismuth is oxidized completely to bismuth oxide. As a result of such interruption, oxygen will not be combined with a part of tin of the alloy, because tin is less readily combinable than with oxygen than is bismuth. Thus, the resulting product will comprise a silver-tin matrix with the bismuth oxide and the tin oxide particles being uniformly dispersed throughout the matrix.

Commonly, time and temperature of internal oxidization are subject to variation, but they should be sufficient to oxidize the bismuth. Such factors depend on the size of the material, the composition of the material and the melting temperature of the alloy. This causes a difference in the resultant oxidizing ratio of tin of the alloy. Therefore, the third type materials formed by such method have a little disadvantage of fluctuating of electrical contact characteristics for a variation of the composition ratio of the bismuth oxide and tin oxide which materials of the third type include.

It is a further development of this invention that an improved material of the third type can be obtained by incorporating one of the oxides selected from the group consisting of copper oxide (CuO) and zinc oxide (ZnO) into the first type or the second type material. Such improved contact materials will be formed by interally oxidizing an alloy of silver, bismuth, tin and an additive ingredient taken from the group consisting of copper and zinc. Thereby, the resultant material will comprise a silver matrix with the bismuth-tin oxide, one of oxides taken from the group consisting of bismuth oxide and tin oxide, and one of oxides taken from the group consisting of copper oxide and zinc oxide particles being uniformly dispersed throughout the silver matrix, and will coincide with the material of the fourth type.

The first, the second and the fourth type materials can further be manufactured by method of powder metallurgy. This may be complished by mixing silver, bismuth oxide and tin oxide powder, with or without an additive powder taken from the group consisting of copper oxide and zinc oxide, pressing the mixture in a suitable shape and sintering the pressed mixture at a temperature between 700° and 900° C. for 1 to 5 hours.

These electrical contacts from first to fourth type materials have good contact properties as follows. The first and the second type contact materials do not show recrystallization of the silver matrix at normal annealing and they possess, therefore, a high degree of hardness not only initially but also after annealing, whereas the other silver contact materials have a tendency for recrystallization upon heating, thus a part of their initial hardness being lower. Thus, the first and the second type materials are characterized by a resistance to wear and deformation of contact surface, particularly in applications where contact pressure is high and where contact is closed under high impact force. In addition, the first type materials are characterized by a resistance to welding and the second type materials are characterized by a resistance to arc erosion.

The third and the fourth type contact materials are characterized by a resistance to welding and arc erosion in applications where making and breaking speed of contacts is relatively slow and where the opening force of contacts is relatively low. And due to the recrystallization of the silver-tin matrix or the silver matrix at normal annealing, the third and the fourth type contact materials have a low-degree of hardness after annealing. Therefore, they possess a good mechanical workability. As to the first type, the third type and the fourth type materials, the contact materials containing the sublimate oxide, as mentioned above, have a considerable advantage of a mechanical workability and of a resistance to welding over contact materials having similar compositions but not containing such sublimate oxide.

The contact materials of this invention formed by internal oxidation, are characterized by the properties of high density, high mechanical strength and high resistance to arc erosion which properties are much higher than those of such contact materials having the same composition but being produced by the method of powder metallurgy. Preferred amounts of starting composition of the silver-bismuth oxide-tin oxide contact materials of this invention is 1.6 to 6.5 weight percent of bismuth oxide, 0.1 to 7.5 weight percent of tin oxide, and the balance of silver. In the case of the fourth type contact material, the preferred amount of the additive oxide selected from the group consisting of copper oxide (CuO) and zinc oxide (ZnO) is 0.02 to 1.5 weight percent. In the case of the internally oxidizing methods, a preferred composition of a starting alloy, which is to be internally oxidized, is about 1.5 to 6 weight percent of bismuth, 0.1 to 6 weight percent of tin and the remainder of silver, with or without the additive ingredient of 0.016 to 1.2 weight percent of copper or zinc. (It will be understood that silver, bismuth, tin and copper or zinc may contain a degree of impurities such as is found in "commercial" grades of these metals.)

The smallest percentages by weight of the range for these constituents are the lower limits which result in the benefical characteristics ascribed herein to contact materials of this invention. The highest percentages by weight of bismuth or bismuth oxide and tin or tin oxide are the upper limits of the ranges for these constituents which result in the contact materials of this invention that can be subjected to conventional mechanical working. Particularly, the internally oxidized contact materials of this invention including tin in excess of the upper limit may cause cracks in the resultant material upon mechanical working such as rolling, drawing or the like.

As the fourth type contact materials of this invention including copper oxide or zinc oxide in excess of 1.5 percent by weight may have a tendency of undesirably decreasing the resistance of the material to arc erosion, the content of the copper oxide or zinc oxide is preferably not more than 1.5 percent by weight. In addition, the weight ratio of the bismuth to the tin in the composition of the starting alloy to form the third type contact materials should be more than 1:2. Otherwise, the internal oxidizing treatment of such materials results in the second type contact material because of the presence of activating tin in the combination with oxygen. The contact materials of this invention may also contain other metals, as additives such as suitable base metals, for instance, nickel, cobalt, and iron, for improving the mechanical workability and the resistance of the materials to arc erosion. The preferred amount of such base metals is 0.1 to 0.5 percent by weight.

In general and particularly when the contact materials are desired to be small in size as in the case of revet type contacts, it is advantageous to carry out the internal oxidization after the contacts have been brought substantially into a shape similar to their final shape. In other words, the starting alloy ingot is converted into a wire after repetitions of the cycle of drawing and annealing and the wire is heated in an oxidizing atmosphere, thereby converting the wire from the silver bismuth alloy to the silver bismuth oxide alloy. Finally, the silver bismuth oxide wire is shaped into contact revets by a heading machine or other suitable apparatus.

However, as bismuth is brittle and has a tendency of precipitation along the grain boundaries of the silver alloys, silver alloys containing more than 1 percent by weight bismuth have poor mechanical workability. Thereby, the mechanical working such as drawing, rolling and extruding, often causes crackings at surface layers of the silver alloys. Ordinarily, such crackings make it difficult to fabricate contact revets from the materials by mechanical working steps.

In carrying out this invention, the internal oxidizing process thus preferably comprises two steps, as will be described below, to increase the mechanical workability of silver alloys containing bismuth. The silver, the bismuth and other additives are melted together and poured into a suitable mould to form an ingot. The resulting ingot is shaved on the surface layers to remove casting voids. Then a first internal oxidation is accomplished by heating the ingot at a temperature between 600° C. and the melting temperature of bismuth oxide in an oxidizing atmosphere for a sufficient period. Preferably, the first internal oxidation is carried out until the bismuth is converted into bismuth oxide in the proportion more than 25 area percent at a cross-section of the ingot. The resulting product comprises the oxidized layer at its surface and the non-oxidized area at an inner portion and has, then, a little mechanical workability in all, because the oxidized layer consisting of silver matrix with bismuth oxide particles which are relatively soft and workable, occupies an outside portion of the product where a heavy stress is imparted by mechanically working. The mineral scale hardness of the principal oxides used for the additives of the electrical contact materials are as follows;

cadmium oxide — 3.0
copper oxide — 4.0
bismuth oxide — 4.5
zinc oxide — 4.5
magnesium oxide — 6.0
tin oxide — 6.5
indium oxide — 7.0
aluminum oxide — 9.0

Then, the product is converted into a wire after repetitions of the cycle of mechanical working such as drawing, extruding or the like, and annealing. Then, a second internal oxidation is accomplished by heating the thus made wire at a temperature between 600° C. and 850° C. in the same manner as of the first step for a sufficient time until the bismuth remaining in the inner portion of the wire is oxidized completely to bismuth oxide. Finally, the wire is shaped into electrical contacts of desired shape. This method makes it possible to form a silver bismuth oxide contact having a desired shape from a silver bismuth alloy ingot.

But, in the case of an ingot of large dimensions, such method has a disadvantage that the time period necessary for converting bismuth into bismuth oxide in the proportions more than e.g. 25 area percent at a cross-section of the ingot becomes long. In order to prevent such disadvantage, according to the further development of this invention, the ingot of large dimensions is crushed in to scaly flakes each having a thickness of 0.1 to 1 mm. The scaly flakes are charged into a suitable mould and pressed under reasonable pressure to form a green billet having a porosity of about 5 to 10 percent. The green billet is then heated, to be sintered, in air or other suitable oxidizing atmosphere at a temperature between 600° C. and the melting temperature of bismuth oxide for a sufficient period to completely oxidize the bismuth of the scaly flakes to bismuth oxide. The thus treated billet is again pressed and heated at a temperature between 600° C. and 900° C. to make a sintered billet having a porosity less than 2 percent in the same manner as of the previous step. The thus obtained sintered billet consisting of a heap of scaly flakes which have a silver matrix with bismuth oxide and other additive oxide particles, has mechanical workability.

Then, the sintered billet is converted into a wire after repetitions of the cycle of mechanical working such as drawing, extruding or the like, and annealing to increase the density, strength or other physical properties of the wire. Finally, the wire is shaped into an electrical contact having a desired shape by a heading machine or other suitable apparatus. The silver-bismuth oxide contact formed by such method possesses the contact properties characterized by high hardness and high resistance to arc erosion as obtained by the internally oxidizing method. However, an electrical contact produced from flakes finer than the above defined scaly flakes, or having, previously, oxidized surface layers, will not have very good contact properties.

The following Examples 1 to 19 will illustrate the electrical contact materials and the method of making same according to this invention, but these Examples are intended only to illustrate this invention, and are not to be construed to limit thereby the scope of this invention.

EXAMPLE 1

In accordance with a starting alloy composition of this invention, 0.8 gram bismuth oxide ($Bi_2O_3$), 1.9 grams tin oxide ($SnO_2$) and 47.3 grams fine silver powder, 200 mesh size, were mixed by a dry ball mill to form a mixed powder having a composition of 1.6 weight percent of bismuth oxide, 3.8 weight percent of tin oxide and the remainder silver. 50 Grams of the thus mixed powder was charged into a cylindrical iron mould of 12 mm in sectional diameter and pressed therein at a specific pressure of 4000 kg/cm$^2$ to obtain a green bar. The green bar was, then, sintered by heating in air at 800° C. for 1 hour. And, the bar was re-pressed at a specific pressure of 8000 kg/cm$^2$ and resintered in the same manner as of the previous step, so as to bring about a bonding of the particles of the powder, to increase strength of the material. After this sintering treatment, the bar was converted into a wire of 5 mm in diameter by six repetitions of a cycle of annealing at 800° C. for 1 hour and cold-drawing. The drawing process was followed by the annealing process every time when the diameter of the wire was 11 mm, 10 mm, 9 mm, 8 mm and 6.5 mm. Reduction per pass during drawing amounted to approximately 10 to 18 percent. Finally, after annealing at 800° C. for 1 hour, the wire was shaped into an electrical contact having a spherical head of 7 mm in curvature radius by a heading machine, and the electrical contact was annealed at 700° C. for 1 hour. The final constituent parts of the main oxides included the contacts were identified by X-ray diffractometry as having tin oxide ($SnO_2$) and bismuth-tin oxide ($Bi_2Sn_2O_7$).

The single Table (Example 1) shows the Vickers hardness and contact properties of the thus produced electrical contact. The electrical contact was then subjected to a making and breaking test by an ASTM type testing machine. Operating conditions for the contact test were as follows.

Voltage — 100 V rms A.C.
Current — 50 A.
Power factor — $\cos\phi = 1.0$
Contact pressure — 30 grams
Contact opening force — 40 grams
Contact closing and opening speed — 10 cm/sec.
Number of operation — $2 \times 10^4$ operations
Number of samples — 6 pairs As the contact properties, the single Table (Example 1) shows the minimum and maximum arc erosion losses, and the minimum and maximum numbers of welding time after the above tests as to six contact pairs.

Besides, standard samples were prepared and subjected to the making and breaking test in the same manner as done above to compare the electrical contact of this invention with the standard samples. The thus prepared samples for comparison were as follows;

Sample 1 — silver-cadmium oxide formed by internally oxidizing method

Sample 2 — Silver-bismuth oxide formed by powder metallurgical method

Sample 3 — Silver-bismuth oxide formed by internally oxidizing method.

The single Table also shows the hardness and the contact properties of the samples for comparison.

EXAMPLE 2

Example 2 is the same as Example 1, except that the mixed powder was in a composition of 6.5 weight percent of bismuth oxide ($Bi_2O_3$), 7.5 weight percent of tin oxide ($SnO_2$) and the remainder of silver. The single Table (Example 2) shows the hardness and contact properties of the resultant electrical contact.

EXAMPLE 3

Example 3 is the same as Example 1, except that the mixed powder was in a composition of 3.3 weight percent of bismuth oxide ($Bi_2O_3$), 0.1 weight percent of tin oxide ($SnO_2$) and the remainder of silver. The single Table (Example 3) shows the hardness and contact properties of the resultant electrical contact. The final constituent parts of the main oxides included in resultant electrical contact made herein were identified as having bismuth oxide ($Bi_2O_3$) and bismuth-tin oxide ($Bi_2Sn_2O_7$) by using X-ray diffraction analysis.

EXAMPLE 4

Example 4 is the same as Example 1, except that the mixed powder was in a composition of 3.3 weight percent of bismuth oxide ($Bi_2O_3$), 3.8 weight percent of tin oxide and remainder of silver. The single Table (Example 4) shows the hardness and contact properties of the resultant electrical contact. Density of the wire of 5 mm in diameter was 9.8 grams/cm$^3$ herein.

EXAMPLE 5

Example 5 is the same as Example 1, except for the following points. In Example 5, bismuth oxide ($Bi_2O_3$), tin oxide ($SnO_2$), zinc oxide ($ZnO$) and fine silver powder, 200 mesh size, were mixed by a dry ball mill to form a mixed powder of 50 grams in total weight. The mixed powder was in a composition of 3.3 weight percent of bismuth oxide, 3.8, weight percent of tin oxide, 0.02 weight percent of zinc oxide and the remainder of silver. The single Table (Example 5) shows the hardness and contact properties of the resultant electrical contact.

EXAMPLE 6

Example 6 is the same as Example 1, except for the following point. In Example 6, bismuth oxide ($Bi_2O_3$), tin oxide ($SnO_2$), copper oxide (CuO) and fine silver powder, 200 mesh size, were mixed by a dry ball mill to form a mixed powder of 50 grams in total weight. The mixed powder was in a composition of 3.3 weight percent of bismuth oxide, 3.8 weight percent of tin oxide, 1.5 weight percent of copper oxide and the remainder of silver. The single Table (Example 6) shows the hardness and contact properties of the resultant electrical contact.

EXAMPLE 7

Example 7 is the same as Example 6, as to not only the method but also the composition of the mixed powder. However, in Example 7, after the working by the heading machine, the electrical contact was annealed at 900° C. for 2 hours and quenched. The single Table (Example 7) shows the hardness and contact properties of the thus treated resultant electrical contact. The final constituent parts of the main oxides included in this resultant electrical contact were identified as having bismuth-tin oxide ($Bi_2Sn_2O_7$), tin oxide ($SnO_2$), copper oxide (CuO) and cppper-bismuth oxide ($CuBi_2O_4$) by using X-ray diffraction analysis.

EXAMPLE 8

In accordance with a starting alloy composition of this invention, 3 grams bismuth, 6 grams tin and 191 grams silver were, melted together in an alumina crucible using a high frequency induction furnace, to form a starting alloy having a composition of 1.5 weight percent of bismuth, 3 weight percent of tin and the remainder of silver. The melt was heated to about 1200° C. in argon and poured into a cylindrical iron mould of 15 mm in sectional diameter to obtain an ingot. The ingot was shaved as to its surface layer to remove casting voids and converted into a cylindrical bar at 700° C. in oxygen for 100 hours, and the bar was then converted into a wire of 5 mm in diameter after six time repetitions of a cycle of annealing at 700° C. for 3 hours and cold-drawing. The drawing process was followed by the annealing process every time when diameter of the wire was 11 mm, 10 mm, 9 mm, 8 mm and 6.5 mm. Reduction per pass during drawing amounted to approximately 10 to 18 percent. For a second internal oxidation process, the wire was heated at 700° C. for 120 hours in oxygen, so as to internally oxidize the bismuth remaining in the wire to completely form bismuth oxide. Finally, the wire was shaped into an electrical contact having a spherical head of 7 mm in curvature radius by a heading machine, and the electrical contact was then annealed at 700° C. for 1 hour.

The single Table (Example 8) shows the hardness and contact properties of the thus produced electrical contact measured by subjecting the electrical contact to the same making-and-breaking test as in to Example 1.

EXAMPLE 9

Example 9 is the same as Example 8, except that here a starting alloy was in a composition of 6 weight percent of bismuth, 3 weight percent of tin and the remainder of silver. The single Table (Example 9) shows the hardness and contact properties of the resultant electrical contact. The final constituent parts of the oxides included in the resultant electrical contact herein were identified as having bismuth oxide ($Bi_2O_3$) and tin oxide ($SnO_2$) by using X-ray diffraction analysis.

EXAMPLE 10

Example 10 is the same as Example 8, except that here a starting alloy was in a composition of 3 weight percent bismuth, 0.1 weight percent of tin and the remainder of silver. The single Table (Example 10) shows the hardness and contact properties of the resultant electrical contact.

EXAMPLE 11

Example 11 is the same as Example 8, except that here a starting alloy was in a composition of 3 weight percent of bismuth, 3 weight percent of tin and the remainder of silver. The single Table (Example 11) shows the hardness and contact properties of the resultant electrical contacts. The density of the wire of 5 mm in diameter was 10.2 grams/$cm^3$.

EXAMPLE 12

Example 12 is the same as Example 8, except that here a strating alloy was in a composition of 3 weight percent of bismuth, 3 weight percent of tin, 0.3 weight percent of nickel and the remainder of silver. The single Table (Example 12) shows the hardness and contact properties of the thus made electrical contact.

EXAMPLE 13

In accordance with a starting alloy composition of this invention, 6 grams bismuth, 6 grams tin and 188 grams silver were melted together in an alumina crucible, using a high frequency induction furnace to form a starting alloy having a composition of 3 weight percent bismuth, 3 weight percent tin and the remainder of silver. The melt was heated to about 1200° C. in argon and poured into an iron mould, 15 mm × 30 mm × 70 mm size, to obtain an ingot. The ingot was shaved as to its surface layer to remove casting voids and crushed up to scaly flakes of 0.2 to 0.5 mm thick by a rolling mill. The scaly flaker were charged into a cylindrical iron mould of 20 mm in sectional diameter and pressed at a specific pressure 2000 kg/$cm^2$ to obtain a green billet. The green billet was heated in oxygen at 800° C. for 20 hours. And, again after being pressed at a specific pressure 8000 kg/$cm^2$, the billet was heated in air at 900° C. for 5 hours, and converted into a cylindrical bar of 10 mm in diameter by hot-extruding at 550° C., to increase the density, strength or other physical properties. Then, the bar was cold-drawn to form a wire of 5 mm in diameter. Reduction per pass during drawing amounted to approximately 14 to 23 percent. The bar was annealed at 830° C. for 3 hours after each 35 to 40 percent reduction. Finally, the wire was shaped into an electrical contact having a spherical head of 7 mm in curvature radius by a heading machine, and the electrical contact was annealed at 830° C. for 1 hour.

The Table (Example 13) shows the hardness and contact properties of the thus produced electrical contact measured by subjecting the electrical contact to the same making and breaking test as in Example 1. The density of the wire of 5 mm in diameter was 10.1 grams/cm$^3$, and its electrical conductivity was 85.2 percent in I.A.C.S.

EXAMPLE 14

Example 14 is the same as Example 13, except that here a starting alloy was in a composition of 5 weight percent of bismuth, 3 weight percent of tin and the remainder silver. The single Table (Example 14) shows the hardness and contact properties of the thus produced electrical contact. The final constituent parts the main oxides included in the electrical contact made herein was identified as having bismuth-tin oxide ($Bi_2Sn_2O_7$) and bismuth oxide ($Bi_2O_3$) by using X-ray diffraction analysis. Density of the wire of 5 mm in diameter was 10.0 grams/cm$^3$ and its electrical conductivity was 77.8 percent in I.A.C.S.

EXAMPLE 15

Example 15 is the same as Example 13, except that here a starting alloy was in a composition of 4 weight percent of bismuth, 6 weight percent of tin and the remainder of silver. The single Table (Example 15) shows the hardness and contact properties of the herein made electrical contact. The final constituent parts of the main oxides included in the electrical contact made herein were identified as having bismuth-tin oxide ($Bi_2Sn_2O_7$) and tin oxide ($SnO_2$) by using X-ray diffraction analysis. Density of the wire of 5 mm in diameter was 9.8 grams/cm$^3$ and its electrical conductivity was 76.5 percent in I.A.C.S.

EXAMPLE 16

Example 16 is the same as Example 13, except that herein a starting alloy was in a composition of 3 weight percent of bismuth, 3 weight percent of tin, 1.2 weight percent of zinc and the remainder of silver. The single Table (Example 16) shows the hardness and contact properties of the resultant electrical contact. The final constituent parts of the main oxides included in the electrical contacts were identified as having bismuth-tin oxide ($Bi_2Sn_2O_7$), tin-oxide ($SnO_2$) and zinc-oxide ($ZnO$) by using X-ray diffraction analysis.

EXAMPLE 17

Example 17 is the same as Example 13, except that here a starting alloy was in a composition of 3 weight percent of bismuth, 3 weight percent of tin, 0.016 percent weight of copper and the remainder of silver. The single Table (Example 17) shows the hardness and contact properties of the resultant electrical contact.

EXAMPLE 18

Example 18 is substantially the same as Example 13, and is only different from Example 13 as to the following point. In Example 18, a starting alloy was in a composition of 4 weight percent of bismuth, 6 weight percent of tin, 1.2 weight percent of copper and the remainder of silver. The cylindrical bar of 10 mm in diameter was converted into a wire of 5 mm in diameter after three repetitions of a cycle of annealing at 900° C. for 2 hours, quenching and cold-drawing. The drawing process was followed by the annealing process and the quenching process every time when the diameter of the bar was 10 mm, 8 mm and 6.5 mm. Reduction per pass during drawing amounted to about 14 to 23 percent. And then, after annealing at 900° C. at 2 hours and quenching, the wire was shaped into an electrical contact having a spherical head of 7 mm in curvature radius by a heading machine. Finally the contact was annealed at 900° C. for 1 hour and quenched.

The single Table (Example 18) shows the hardness and contact properties of the thus produced electrical contact. The final constituent parts of the main oxides included in the electrical contact made herein were identified as having bismuth-tin oxide ($Bi_2Sn_2O_7$), tin oxide ($SnO_2$), copper oxide ($CuO$) and copper-bismuth oxide ($CuBi_2O_4$) by using X-ray diffraction analysis.

EXAMPLE 19

Example 19 is the same as Example 18, except that here a starting alloy was in a composition of 4 weight percent of bismuth, 4 weight percent of tin, 1 weight percent of zinc, 0.5 weight percent of nickel and the remainder of silver. The single Table (Example 19) shows the hardness and contact properties of the thus produced electrical contact. The final constituent parts of main oxides included in the electrical contact made herein were identified as having bismuth-tin oxide ($Bi_2Sn_2O_7$), zinc-bismuth oxide ($ZnBi_4O_7$), tin oxide ($SnO_2$) and zinc oxide ($ZnO$) by using X-ray diffraction analysis.

As apparent from the single Table, silver-bismuth oxide contact is characterized by a resistance to welding which is considarably higher than that of silver-cadmium oxide contact. But, the arc erosion loss of the silver-bismuth oxide contact is very high in comparison with that of the silver-cadmium oxide contact. On the other hand, the contacts according to this invention possess a high resistance to not only welding but also arc erosion.

Table

| Example Number | Composition of original mixture or starting alloy (wt. %) | Vickers Hardness (0.5 kg) | Number of welding time | Arc erosion loss (mg) |
|---|---|---|---|---|
| 1 | 1.6 $Bi_2O_3$-3.8$SnO_2$-Ag | 65.5 | 168–254 | 8.9–13.2 |
| 2 | 6.5$Bi_2O_3$-7.5$SnO_2$-Ag | 84.0 | 5–13 | 5.8–9.5 |
| 3 | 3.3$Bi_2O_3$-0.1$SnO_2$-Ag | 47.8 | 98–145 | 10.3–15.4 |
| 4 | 3.3$Bi_2O_3$-3.8$SnO_2$-Ag | 77.7 | 19–55 | 4.6–10.5 |
| 5 | 3.3$Bi_2O_3$-3.8$SnO_2$-0.02ZnO-Ag | 68.5 | 22–48 | 4.8–7.2 |
| 6 | 3.3$Bi_2O_3$-3.8$SnO_2$-1.5CuO-Ag | 58.2 | 18–40 | 5.8–8.7 |
| 7 | 3.3$Bi_2O_3$-3.8$SnO_2$-1.5CuO-Ag | 44.6 | 15–38 | 6.3–7.9 |
| 8 | 1.5Bi-3Sn-Ag | 55.3 | 265–334 | 6.3–7.2 |
| 9 | 6Bi-3Sn-Ag | 65.8 | 8–17 | 2.6–5.5 |
| 10 | 3Bi-0.1Sn-Ag | 40.3 | 183–222 | 7.4–8.3 |
| 11 | 3Bi-3Sn-Ag | 51.9 | 33–68 | 1.8–4.9 |
| 12 | 3Bi-3Sn-0.3Ni-Ag | 58.6 | 24–47 | 1.6–3.7 |
| 13 | 3Bi-3Sn-Ag | 93.4 | 44–79 | 2.2–5.4 |
| 14 | 5Bi-3Sn-Ag | 88.1 | 18–36 | 2.7–6.8 |
| 15 | 4Bi-6Sn-Ag | 101.6 | 21–48 | 1.5–2.6 |
| 16 | 3Bi-3Sn-1.2Zn-Ag | 72.3 | 16–43 | 1.7–3.0 |
| 17 | 3Bi-3Sn-0.016Cu-Ag | 58.2 | 39–65 | 2.2–4.3 |
| 18 | 4Bi-6Sn-1.2Cu-Ag | 64.2 | 49–66 | 2.6–4.0 |
| 19 | 4Bi-4Sn-1Zn-0.5Ni-Ag | 67.7 | 13–25 | 1.2–3.1 |

Table-continued

| Example Number | | Composition of original mixture or starting alloy (wt. %) | Vickers Hardness (0.5 kg) | Number of welding time | Arc erosion loss (mg) |
|---|---|---|---|---|---|
| Samples for Comparison | 1 | 12Cd-Ag | 50.5 | 358–824 | 2.8–5.2 |
| | 2 | $6Bi_2O_3$-Ag | 53.7 | 29–68 | 11.6–17.0 |
| | 3 | 5Bi-Ag | 54.6 | 55–86 | 8.5–9.2 |

What is claimed is:

1. An electrical contact material comprising a metal component as a major ingredient and the remainder being a metal oxide component as a minor ingredient, said metal component consisting essentially of silver with or without tin, and said metal oxide component consisting essentially of bismuth oxide and tin oxide, wherein the amount of the bismuth of said bismuth oxide is 1.5 to 6 weight percent, and the total amount of the tin of said metal component and the tin of said metal oxide component is 0.1 to 6 weight percent, respectively, both on the basis of the sum of said metal component and all the metals of said metal oxide component.

2. An electrical contact material according to claim 1, wherein said metal component is present in the form of a silver-tin matrix, and said metal oxide component is present in the form of bismuth oxide particles ($Bi_2O_3$) and tin oxide particles ($SnO_2$) uniformly dispersed in said silver-tin matrix.

3. An electrical contact material according to claim 1, wherein said metal component is present in the form of silver matrix, and said metal oxide component is present in the form of bismuth-tin oxide particles ($Bi_2Sn_2O_7$) and particles of one of bismuth oxide ($Bi_2O_3$) or tin oxide ($SnO_2$) uniformly dispersed in said silver matrix.

4. An electrical contact material according to claim 3, wherein said electrical contact material is made by compressing and sintering a starting mixture consisting essentially of 1.6 to 6.5 weight percent of bismuth oxide ($Bi_2O_3$), 0.1 to 7.5 weight percent of tin oxide ($SnO_2$) and the remainder of a fine silver powder.

5. An electrical contact material according to claim 1, wherein said metal component is present in the form of a silver matrix, and said metal oxide component is present in the form of bismuth-tin oxide particles ($Bi_2Sn_2O_7$) uniformly dispersed in said silver matrix.

6. An electrical contact material according to claim 1, wherein said electrical contact material is made by internally oxidizing a starting alloy consisting essentially of 1.5 to 6 weight percent of bismuth, 0.1 to 6 weight percent of tin, and the remainder of silver.

7. An electrical contact material according to claim 1, wherein said metal oxide component contains an additive oxide of one of copper oxide and zinc oxide, wherein the amount of the metal of said additive oxide is 0.016 to 1.2 weight percent on the basis of the sum of said metal component and all the metals of said metal oxide component.

8. An electrical contact material according to claim 7, wherein said metal component is present in the form of a silver matrix, and said metal oxide component is present in the form of bismuth-tin oxide particles ($Bi_2Sn_2O_7$), and one of bismuth oxide particles ($Bi_2O_3$) or tin oxide particles ($SnO_2$), and one of copper oxide particles (CuO) or zinc oxide particles (ZnO), all uniformly dispersed in said silver matrix.

9. An electrical contact material according to claim 7, wherein said metal oxide component is present in the form of a silver matrix, and said metal oxide component is present in the form of bismuth-tin oxide particles ($Bi_2Sn_2O_7$), and one of bismuth oxide particles ($Bi_2O_3$) or tin oxide particles, and one of copper oxide particles (CuO) or zinc oxide particles (ZnO), and one of copper-bismuth oxide particles or zinc-bismuth oxide particles uniformly dispersed in said silver matrix.

10. An electrical contact material according to claim 9, wherein said copper-bismuth oxide particles and said zinc-bismuth oxide particles have the formulae $CuBi_xO_y$ and $ZnBi_xO_y$, respectively, where said x is the integer 2, 4 or 48, and said y is the integer 4, 7 or 73 when said x is the integer 2, 4 or 48, respectively.

11. An electrical contact material according to claim 10, wherein said copper-bismuth oxide particles has the formula $CuBi_2O_4$, and said zinc-bismuth oxide particles has the formula $ZnBi_4O_7$ or $ZnBi_{48}O_{78}$.

12. An electrical contact material according to claim 7, wherein said electrical contact material is made by internally oxidizing a starting alloy consisting essentially of 1.5 to 6 weight percent of bismuth, 0.1 to 6 weight percent of tin, 0.016 to 1.2 weight percent of one of copper and zinc, and the remainder being silver.

13. An electrical contact material according to claim 7, wherein said electrical contact material is made by compressing and sintering a starting mixture consisting essentially of 1.6 to 6.5 weight percent of bismuth oxide ($Bi_2O_3$), 0.1 to 7.5 weight percent of tin oxide ($SnO_2$), 0.02 to 1.5 weight percent of one of copper oxide (CuO) and zinc oxide (ZnO), and the remainder being a fine silver powder.

14. A method of making an electrical contact material, comprising: melting a starting metal mixture to a molten alloy, said starting metal mixture consisting essentially of 1.5 to 6 weight percent of bismuth, 0.1 to 6 weight percent of tin, and the remainder of silver; cooling said molten alloy to an alloy ingot; and internally oxidizing bismuth in said alloy ingot to bismuth oxide by heating in an oxidizing atmosphere.

15. A method according to claim 14, wherein said internal oxidizing step comprises: first heating said alloy ingot in an oxidizing atmosphere at a temperature between 600° C. and the melting temperature of bismuth oxide so as to internally oxidize the bismuth in a surface layer of said alloy ingot to bismuth oxide; shaping the thus treated alloy ingot to a desired shape for the electrical contact material; and second, heating the thus shaped alloy ingot in an oxidizing atmosphere at a temperature between 600° C. and 850° C. so as to internally oxidize the bismuth, still remaining as metal bismuth in said alloy ingot after said first heating step, to bismuth oxide.

16. A method according to claim 15, wherein a cross-sectional area of said alloy ingot, wherein said alloy ingot is oxidized by said first heating step to such a depth that at least 25% of the cross sectional area of said alloy ingot is oxidized by said first heating step.

17. A method according to claim 15, wherein said alloy ingot, after said second heating step, is further subjected to a third heating step at a temperature between 870° C. and the melting temperature of silver, and is then quenched.

18. A method according to claim 14, wherein prior to said internal oxidizing step, said alloy ingot is crushed to scaly flakes each having a thickness of 0.1 to 1 mm, and the thus made flakes are compressed to a green billet having a porosity of about 5 to about 10 percent, and said internal oxidizing step comprising heating said gree billet in an oxidizing atmosphere at a temperature between 600° C. and the melting temperature of bismuth oxide so as to completely oxidize the bismuth in said flakes to bismuth oxide, wherein the thus heated flakes are further compressed to a compact body having a porosity less than 2 percent, and then reheating the thus made compact body in an oxidizing atmosphere at a temperature between 600° C. and the melting temperature of silver, to form a sintered body which is ready for shaping to a desired shape to form the electrical contact material.

19. A method according to claim 18, wherein said reheating step is carried out at a temperature higher than 870° C., and said sintered body is quenched, then annealed at a temperature between 870° C. and the melting temperature of silver, and then further quenched.

* * * * *